US005708912A

United States Patent [19]

Lee

[11] Patent Number: 5,708,912

[45] Date of Patent: Jan. 13, 1998

[54] METHOD AND DEVICE FOR DISPLAYING AN EXCHANGE MESSAGE FOR A PROCESS CARTRIDGE WITH A PROCESS CARTRIDGE COMPRISING A NON-VOLATILE MEMORY FOR STORING DATA VALUES

[75] Inventor: Dong-Ho Lee, Suwon, Rep. of Korea

[73] Assignee: SamSung Electronics Co., Ltd., Suwon, Rep. of Korea

[21] Appl. No.: 555,753

[22] Filed: Nov. 9, 1995

[30] Foreign Application Priority Data

Nov. 10, 1994 [KR] Rep. of Korea ..... 29454/1994

[51] Int. Cl.[6] ..... G03G 15/00

[52] U.S. Cl. ..... 399/24; 399/27; 399/81

[58] Field of Search ..... 399/24, 25, 27, 399/43, 81

[56] References Cited

U.S. PATENT DOCUMENTS

| | | | |
|---|---|---|---|
| 4,462,677 | 7/1984 | Onoda | 355/210 |
| 4,470,689 | 9/1984 | Nomura et al. | 355/211 |
| 4,496,237 | 1/1985 | Schron | 355/209 |
| 4,538,896 | 9/1985 | Tajima et al. | 355/200 |
| 4,588,280 | 5/1986 | Ogawa et al. | 355/200 |
| 4,851,875 | 7/1989 | Tanimoto | 355/245 |
| 4,873,549 | 10/1989 | Tada et al. | 355/206 |
| 4,961,088 | 10/1990 | Gilliland et al. | 355/206 |
| 5,066,978 | 11/1991 | Watarai et al. | 355/206 |
| 5,101,233 | 3/1992 | Ito et al. | 355/209 |
| 5,155,528 | 10/1992 | Gokita et al. | 355/210 X |
| 5,283,597 | 2/1994 | Yoshida et al. | 355/206 X |
| 5,452,059 | 9/1995 | Sekiya | 355/210 |
| 5,508,795 | 4/1996 | Kikuchi | 355/260 |
| 5,548,374 | 8/1996 | Iguchi et al. | 355/200 |

*Primary Examiner*—William J. Royer
*Attorney, Agent, or Firm*—Robert E. Bushnell, Esq.

[57] ABSTRACT

A device for displaying an exchange message for a process cartridge installed within a body of an image forming apparatus provides a user with an indication that the process cartridge should be exchanged for a new process cartridge. The device includes the process cartridge which combines a non-volatile memory for storing data values, a photosensitive drum, a toner sensor for detecting a remaining quantity of toner, a cleaning blade and a waste toner receptacle as a unitary structure capable of being installed within and removed from the body of the image forming apparatus. A toner cartridge stores the toner and is capable of being attached to and detached from the process cartridge. A display device displays predetermined messages regarding the states of the process cartridge and the toner cartridge. A video controller receives a print command from a host computer and controls a printing operation performed by the image forming apparatus by incrementing the data values according to the remaining quantity of toner detected by the toner sensor. The video control also enables the display device to display the exchange message indicating that the process cartridge should be exchanged for a new process cartridge when one of the data values representative of a number of times the toner cartridge has required exchange for a new toner cartridge equals a predetermined value.

13 Claims, 6 Drawing Sheets

METHOD AND DEVICE FOR DISPLAYING AN EXCHANGE MESSAGE FOR A PROCESS CARTRIDGE WITH A PROCESS CARTRIDGE COMPRISING A NON-VOLATILE MEMORY FOR STORING DATA VALUES

CROSS-REFERENCE TO RELATED APPLICATIONS

This application makes reference to, incorporates the same herein, and claims all benefits accruing under 35 U.S.C. 517 119 from an application for Method And Device For Displaying An Exchange Message For A Process Cartridge earlier filed in the Korean Industrial Property Office on Nov. 10 1994 and there assigned Ser. No. 29454/1994.

BACKGROUND OF THE INVENTION

The present invention relates to an image forming apparatus, and more particularly to a device and method for displaying an exchange message for a process cartridge in an image forming apparatus.

A process cartridge is provided to unite a charging device, a luminous exposure device, and a developing device in an image forming apparatus using an electrophotographic developing process such as a copying machine, a laser printer and a facsimile for plain paper.

One example of the process cartridge is disclosed in U.S. Pat. No. 3,985,436. U.S. Pat. No. 3,985,436 is characterized in that a photosensitive drum, a cleaner and a developing device are united as a single cartridge, thereby making it possible to exchange the process cartridge with a new one when some expendable portion(s) of the cartridge, such as the photosensitive drum or toner, need to be exchanged or replaced. Other examples of the process cartridge are disclosed in U.S. Pat. Nos. 4,538,896, 4,588,280, 4,462,677, and 4,470,689. Still other examples are disclosed in Korean patent application No. 92-23941 and German patent application No. 41 38 079.7-51, which were filed by the same applicant as the present invention. While the conventional process cartridges cited above provide a user with the ability to exchange an expended process cartridge with a new process cartridge, I note that the conventional art can be improved upon to provide the user with an accurate indication as to when the process cartridge should be replaced.

SUMMARY OF THE INVENTION

Accordingly, it is an object of the present invention to provide a device and method for displaying an exchange message for a process cartridge.

It is another object to provide a process cartridge capable of preventing toner contamination within an image forming apparatus attributable to waste toner.

It is still another object to provide a device and method for displaying an exchange message for a toner cartridge to thereby prevent the use of poor quality toner.

These and other objects can be achieved by a first embodiment of the present invention with a device for displaying an exchange message for a process cartridge installed within a body of an image forming apparatus. The device according to the first embodiment includes: the process cartridge having a non-volatile memory for storing data values, a photosensitive drum, a toner sensor for detecting a remaining quantity of toner, a cleaning blade and a waste toner receptacle combined as a unitary structure capable of being installed within and removed from the body of the image forming apparatus. A toner cartridge stores the toner and is capable of being attached to and detached from the process cartridge. A display means displays predetermined messages regarding the states of the process cartridge and the toner cartridge. A controller receives a print command from a host computer and controls a printing operation performed by the image forming apparatus by incrementing the data values stored in the non-volatile memory according to the remaining quantity of toner detected by the toner sensor. The controller means enables the display to display the exchange message indicating that the process cartridge should be exchanged for a new process cartridge when one of the data values representative of the number of times the toner cartridge has required exchange for a new toner cartridge equals a predetermined value.

These and other objects can also be achieved by a second embodiment of the present invention with a device for displaying an exchange message for a process cartridge installed within a body of an image forming apparatus. The device according to the second embodiment includes the process cartridge having a first non-volatile memory for storing a first value representative of a number of times a toner cartridge has required exchange for a new toner cartridge, a photosensitive drum, a toner sensor for detecting a quantity of toner remaining within the toner cartridge, a cleaning blade and a waste toner receptacle combined into a unitary structure capable of being installed within and removed from the body of the image forming apparatus. The toner cartridge, which stores the toner and is capable of being attachable to and detachable from the process cartridge, includes a second non-volatile memory for storing a second value representative of the quantity of toner remaining within the toner cartridge. A display displays predetermined messages regarding the states of the process cartridge and the toner cartridge. A controller receives a print command from a host computer and controls a printing operation performed by the image forming apparatus by incrementing the second value stored in the second non-volatile memory whenever an absence of toner is detected by the toner sensor. The controller also enables the display to display the exchange message indicating that the process cartridge should be exchanged for a new process cartridge when the first value stored in the first non-volatile memory equals a first predetermined value, and further enables the display means to display a toner cartridge exchange message indicating that the toner cartridge should be exchanged for a new toner cartridge when the second value stored in the second non-volatile memory is not equal to a second predetermined value.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

FIG, 1 is a view illustrating the structure of a conventional process cartridge and toner cartridge.

Figure 4:
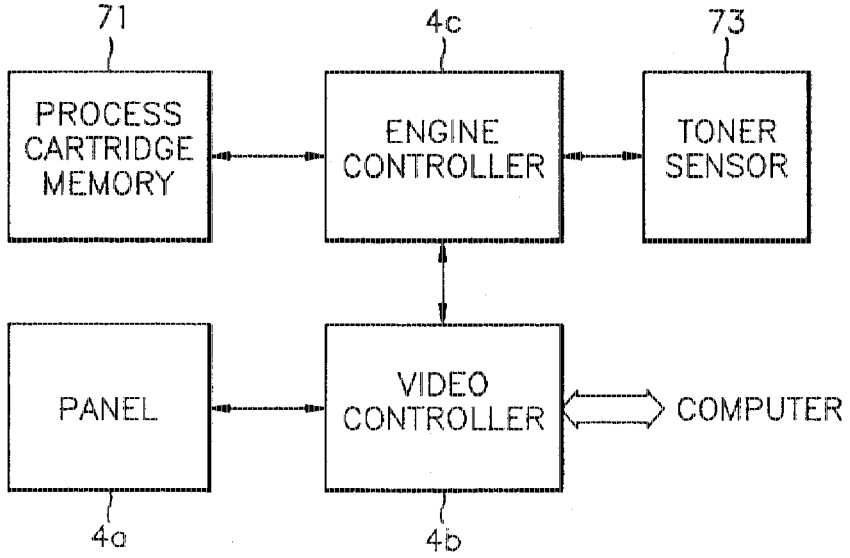
Figure 5:
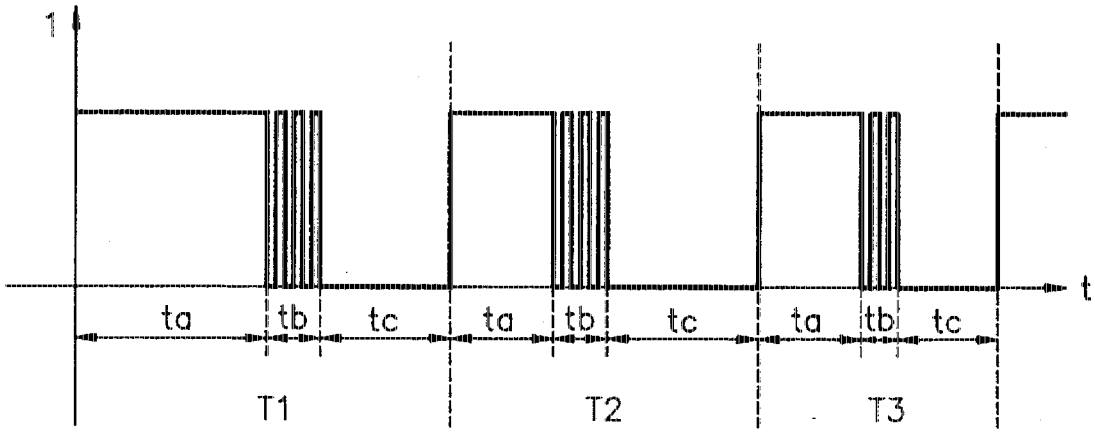
Figure 7:
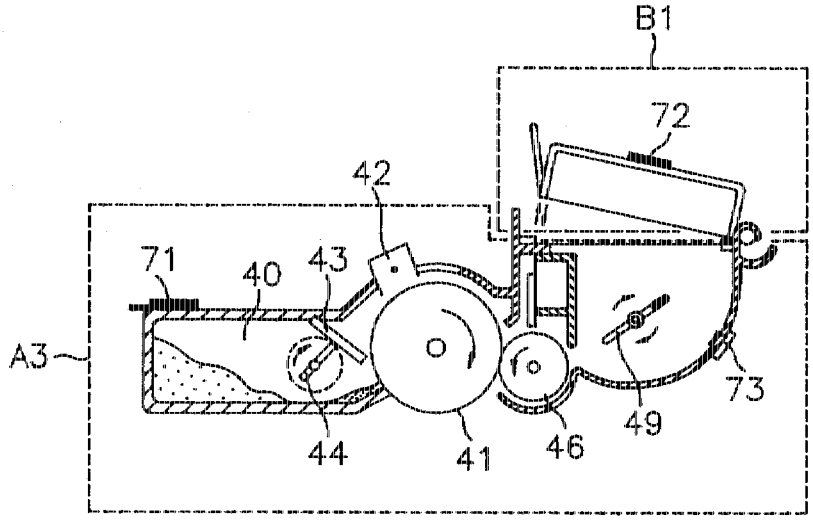
Figure 11:
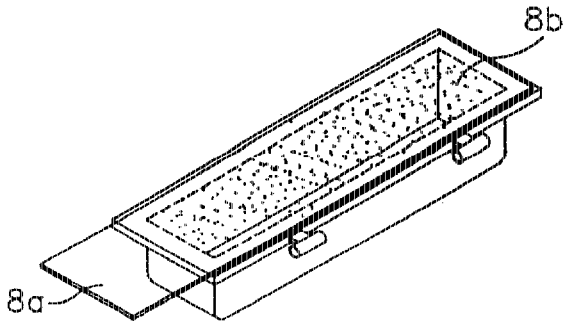
Figure 6:
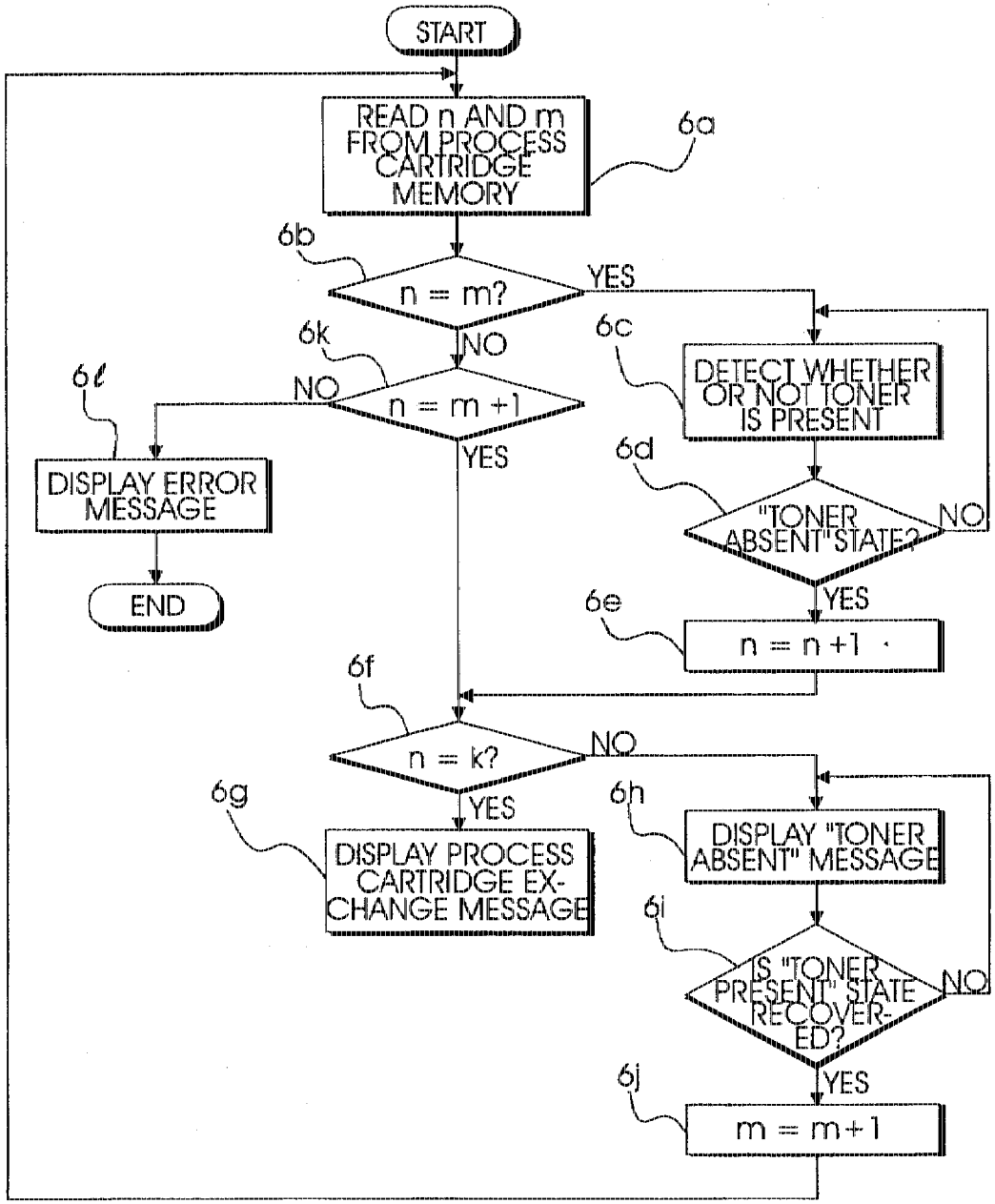
Figure 8:
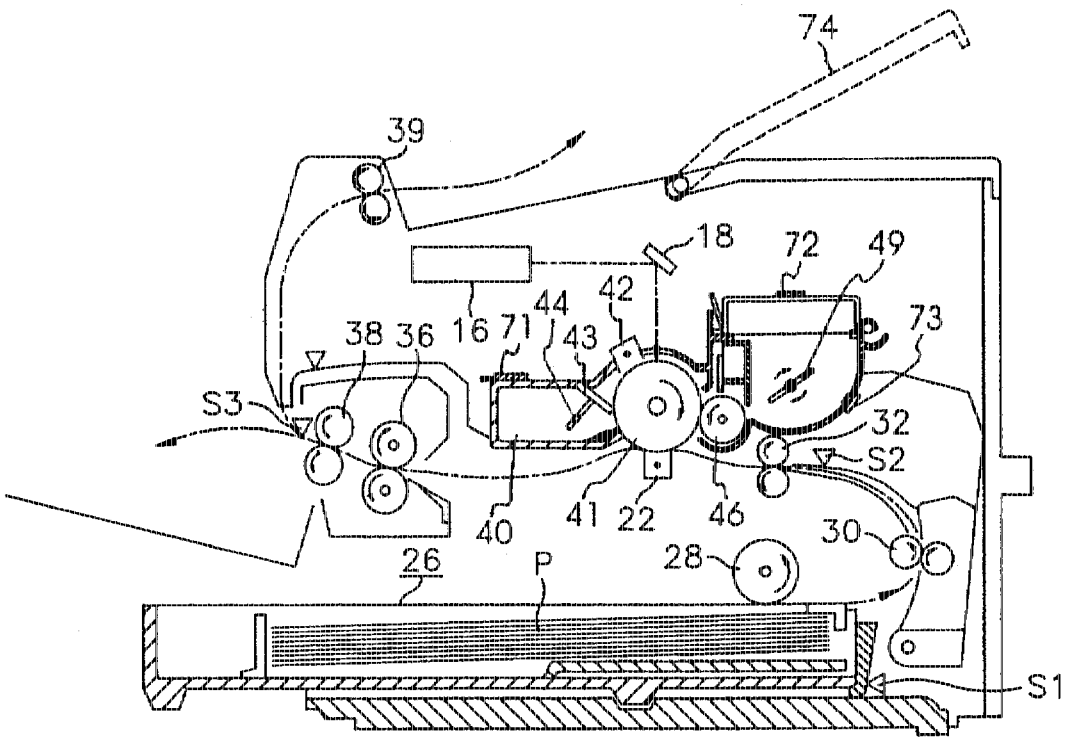
Figure 9:
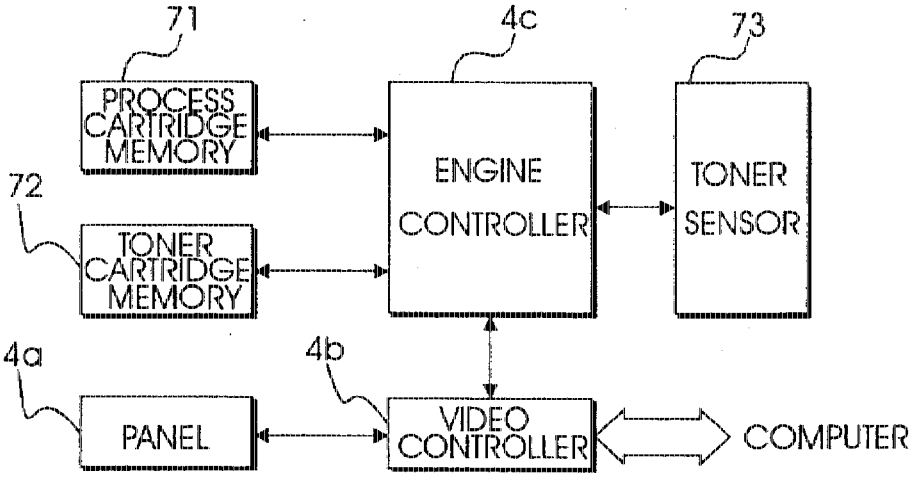
Figure 10:
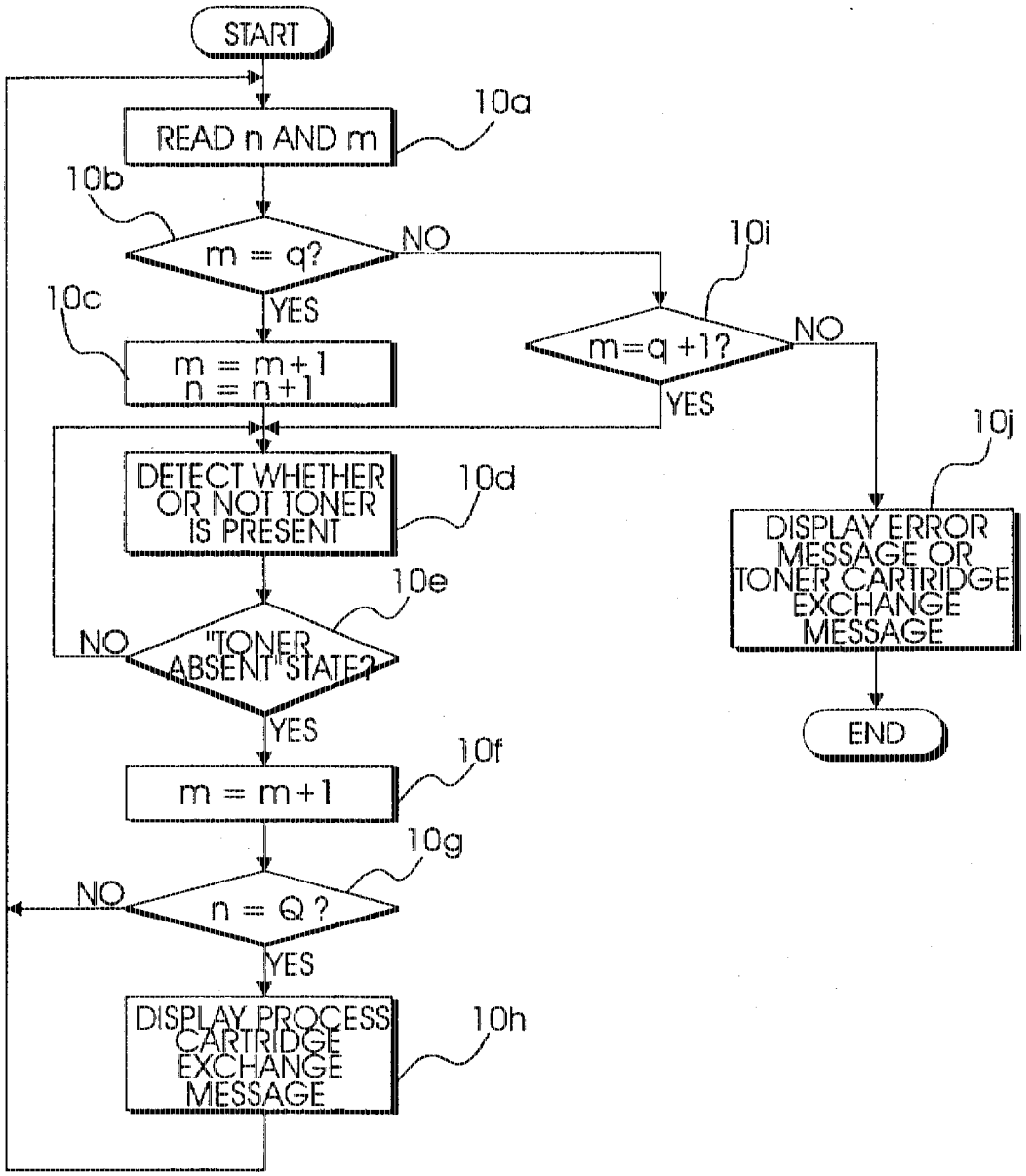

FIG, 3 is a view illustrating a laser beam printer in which the process cartridge and toner cartridge of FIG, 2 are installed;

FIG. 4 is a block diagram illustrating portions of the laser beam printer constructed according to the first embodiment of the present invention;

FIG. 5 is a view illustrating an exemplary waveform of a toner detecting signal generated by a toner sensor;

FIG. 6 is a flowchart illustrating a method of displaying an exchange message for the process cartridge and toner cartridge constructed according to the first embodiment of the present invention;

FIG. 7 is a view illustrating the structure of a process cartridge and toner cartridge constructed according to a second embodiment of the present invention;

FIG. 8 is a view illustrating a laser beam printer in which the process cartridge and toner cartridge of FIG. 7 are installed;

FIG. 9 is a block diagram illustrating portions of a laser beam printer constructed according to the second embodiment of the present invention;

FIG. 10 is a flowchart illustrating a method of displaying an exchange message for the process cartridge constructed according to the second embodiment of the present invention; and FIG. 11 is a perspective view illustrating the structure of the toner cartridge embodied in the present invention.

DETAILED DESCRIPTION OF THE PREFERRED EMBODIMENT

Figure 1:
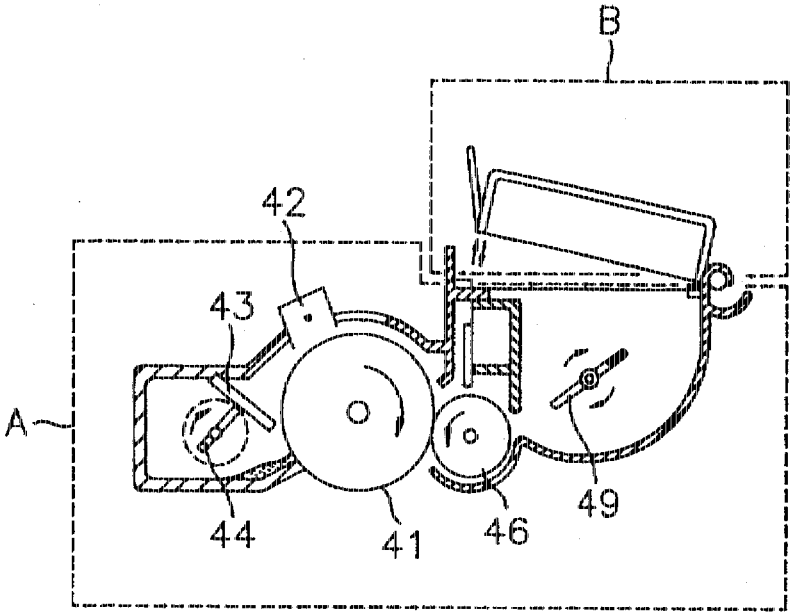

Turning now to the drawings and referring to FIG. 1, a cross-sectional view of a toner cartridge attachable to a process cartridge, as disclosed in Korean patent application No. 92-23941, is shown. FIG. 1 is comprised of process cartridge A, and toner cartridge B which can be attached to and detached from process cartridge A. Process cartridge A is a housing wherein a photosensitive drum 41, a charging unit 42, a cleaning blade 43, a waste toner transporting wing 44, and a developing unit having a developing roller 46 and a toner agitating wing 49 are united into a unitary body. Process cartridge A of FIG. 1 has been determined to cause a toner contamination problem attributable to waste toner being discharged to an exterior of the apparatus by the operation of waste toner transporting wing 44. Since toner contamination poses a serious problem in the image forming apparatus, it is imperative that this issue be addressed.

In the detailed description that follows, several specific circuit elements are provided for a comprehensive understanding of the present invention. These specific elements are not intended to be limiting in any manner. Accordingly, it is evident that a person having ordinary skill in the relevant art can carry out the present invention without the specific elements that are disclosed. Moreover, a description of well-known elements has been omitted so as not to obscure the present invention.

Figure 2:
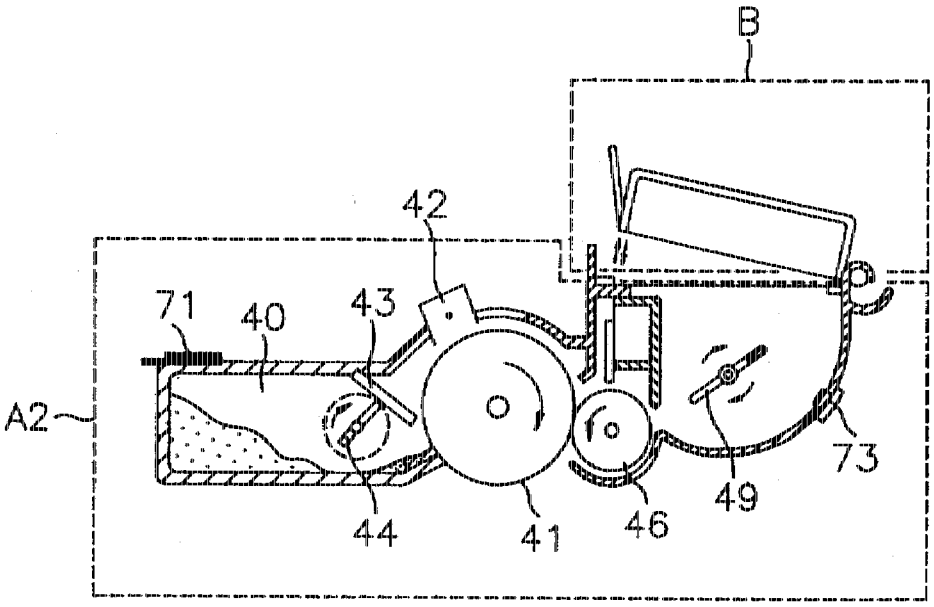
FIG. 2 is a view illustrating the structure of a process cartridge and toner cartridge constructed according to a first embodiment of the present invention.

Referring now to FIG. 2, a cross-sectional view of a process cartridge and a toner cartridge constructed according to a first embodiment of the present invention is shown. In FIG. 2, a process cartridge A2 includes a process cartridge memory 71, a toner waste receptacle 40, a photosensitive drum 41, a charging unit 42, a cleaning blade 43, a waste toner transporting wing 44, and a developing unit having a developing roller 46, a toner agitating wing 49 and a toner sensor 73 which are combined as a unitary structure. A toner cartridge B is attachable to and or detachable from process cartridge A2. As shown in FIG. 2, process cartridge A2 provides toner waste receptacle 40 so that waste toner is not discharged to an exterior of the apparatus, thereby helping to prevent the toner contamination problem. Toner cartridge B is illustrated in more detail in FIG. 11, and includes an adhesive film 8*a* and toner 8*b*.

Figure 3:
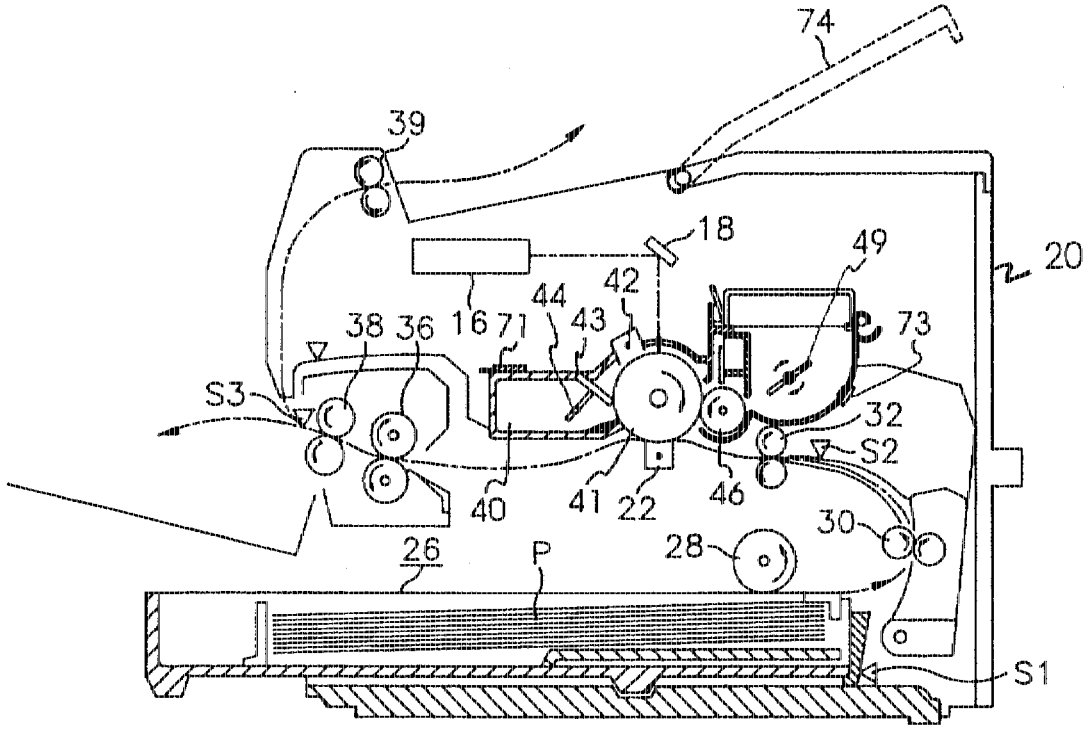

FIG. 3 is a cross-sectional view illustrating a laser beam printer in which process cartridge A2 and toner cartridge B of FIG. 2 are installed. Process cartridge A2 is installed within a body 20 of the laser beam printer after a cover 74 of body 20 of the laser beam printer is opened. Thus, if the exchange period of an expendable item, such as photosensitive drum 41, is terminated, cover 74 of body 20 is opened and the exhausted process cartridge is removed and exchanged with a new process cartridge. In the case of utilizing an organic photoconductor (OPC) for photosensitive drum 41, about 15,000 to 20,000 sheets can be printed. Toner cartridge B, which is constructed so that it can be attached to or detached from process cartridge A2, has an exchange period determined by an internal toner storage capacity. In general, toner cartridge B contains enough toner to print about 3,000 sheets. The laser beam printer of FIG. 3 further includes a paper cassette 26 for storing sheets of paper P. A first sensor S1 senses the installation of paper cassette 26 within body 20 of the laser beam printer, and a pick-up roller 28 extracts paper P from paper cassette 26. A first set of register rollers 30 and a second set of register rollers 32 receive and arrange paper P provided by pick-up roller 28, while a second sensor S2 senses paper P as it passes between the first set of register rollers 30 and the second set of register rollers 32. An exposing unit 16 exposes photosensitive dram 41 with light through reflecting means 18 and a transfer unit 22 transfers toner onto paper P as it passes between transfer unit 22 and photosensitive drum 41. Fixing rollers 36 secure the toner upon paper P. A first set of delivery rollers 38 receive paper P from fixing rollers 36 and deliver the paper P past a third sensor S3 to either a first exit on the side of the laser beam printer, or to a second exit on the top of the laser beam printer via a second set of delivery rollers 39.

FIG. 4 is a block diagram illustrating a portion of the laser beam printer constructed according to the first embodiment of the present invention. The laser beam printer has a known construction comprising an engine portion having a printing apparatus (not shown) and an engine controller 4*c*, and a video controller 4*b* for receiving various control data associated with printing from a panel 4*a* and print data from a computer. Process cartridge memory 71 and toner sensor 73 are connected to exchange data with engine controller 4*c*. Video controller 4*b* converts the control data and print data to bit map data (i.e., video data) before delivering the data to engine controller 4*c*. Engine controller 4*c* and video controller 4*b* are comprised of a central processing unit (CPU), a read only memory (ROM) and a random access memory (RAM), namely a non-volatile RAM (NVRAM) for storing the number of printed sheets that have been generated.

FIG. 5 shows an exemplary waveform of a toner detecting signal output from toner sensor 73, which is a piezoelectric type of sensor. In FIG. 5, T1 represents a period where a change in an amount of toner within a first toner cartridge is detected. T2 represents a period where the change in the amount of toner within a second toner cartridge (i.e., that has been exchanged for the first toner cartridge) is detected. T3 represents a period where the change in the amount of toner within a third toner cartridge (i.e., that has been exchanged for the second toner cartridge) is detected. When the toner level within the toner cartridge is normal, toner sensor 73 outputs a digital signal in a logic "high" state, which denotes section $t_a$ within each period. For example, if the volume of toner cartridge B is enough to generate 3,000 copies, a signal indicating that the toner level is normal is stably output by toner sensor 73 for the period during which the first 2,500 copies are produced, as shown in section $t_a$, of FIG. 5. However, after the first 2,500 copies are produced, the remaining amount of toner within the toner cartridge diminishes and signals indicating a "toner present" state and a "toner absent" state are alternately and irregularly generated, as shown in section $t_b$, of FIG. 5. At this time, if the printing operation is continued, the signal indicative of the "toner absent" state is eventually generated in a continuous manner, as shown in section $t_c$ of FIG. 5. The method of detecting the amount of toner within the toner cartridge has been disclosed in detail in Korean Patent No. 94-3776 filed by the same assignee, Samsung Electronics Co., Ltd., as the present invention.

Details of the method for determining the exchange time of the process cartridge constructed according to the first embodiment of the present invention will now be explained. Note that the present invention uses process cartridge memory 71 and toner sensor 73 to effectuate its principles.

According to the first embodiment of the present invention, it is assumed that process cartridge memory 71 is a non-volatile memory that stores two data variables (i.e., fields) n and m. It is further assumed that upon manufacture, data variables n and m stored in process cartridge memory 71 are both set equal to zero, as indicated in Table 1 which will be described later. When the "toner absent" state is continuously detected (i.e., section $t_c$ in FIG. 5) by toner sensor 73, the value of n is increased by one. Then, when the expended toner cartridge is exchanged for a new toner cartridge, the "toner absent" state changes to the "toner present" state, and the value of m is increased by one. While the values of n and m are increased in this manner, when the value of n equals five, a process cartridge exchange message indicating that process cartridge A2 should be exchanged with a new process cartridge is displayed. In this embodiment, the maximum value for n is set to five, and the exchange time for process cartridge A2 is defined as the point in time when n reaches five. This value for n, however, is not intended to be limiting and can be properly changed according to design preference based on the expected life of toner cartridge B. That is, the value n indicates the number of times toner cartridge B has reached the point where exchange for a new toner cartridge is required, and process cartridge A2 is exchanged based on the value of n.

When a user installs a first toner cartridge (i.e., n=0 and m=0), after sections $t_a$ and $t_b$ of the period T1 in FIG. 5 have passed and the "toner absent" state is continuously detected by toner sensor 73 in section $t_c$, it is determined that the first toner cartridge's life has expired and the value of n stored in process cartridge memory 71 is incremented by one so that n=1 and m=0. Then, if a second toner cartridge is provided and the signal indicating the "toner present" state is continuously detected, as shown in section $t_a$, of the period T2 in FIG. 5, it is determined that a new toner cartridge has been installed and the value of m stored in process cartridge memory 71 is incremented by one so that n=1 and m=1. If this process continues and the value of n (which represents the number of times toner cartridge B has reached the point where exchange is necessary) stored in process cartridge memory 71 equals the predetermined number (i.e., five in this embodiment), the process cartridge exchange message indicating that the presently installed process cartridge should be exchanged for a new process cartridge is displayed.

Table 1 provides information stored in process cartridge memory 71 and includes values indicative of the number of times an expended toner cartridge has been exchanged for a new toner cartridge, an amount of toner, and the state of the toner cartridge.

TABLE 1

| n | m | Toner State | Toner Cartridge State |
|---|---|---|---|
| 0 | 0 | normal | first toner cartridge is being used |
| 1 | 0 | display "toner absent" message | first toner cartridge's life has expired |
| 1 | 1 | normal | second toner cartridge is being used |
| 2 | 1 | display "toner absent" message | second toner cartridge's life has expired |
| 2 | 2 | normal | third toner cartridge is being used |
| 3 | 2 | display "toner absent" message | third toner cartridge's life has expired |
| 3 | 3 | normal | fourth toner cartridge is being used |
| 4 | 3 | display "toner absent" message | fourth toner cartridge's life has expired |
| 4 | 4 | normal | fifth toner cartridge is being used |
| 5 | | display process cartridge exchange message | fifth toner cartridge's life has expired |

FIG. 6 is a flowchart illustrating a control operation performed by the central processing unit (CPU) of video controller 4b in accordance with the first embodiment of the present invention.

Referring now to FIG. 6, the central processing unit (CPU) of video controller 4b first reads the values of n and m stored in process cartridge memory 71 in step 6a, and then determines whether the values of n and m are equal in step 6b. If the value of n is equal to the value of m, an output from toner sensor 73 is mad, the remaining amount of toner is analyzed in accordance with the read value, and a program for detecting whether or not toner is present is executed to thereby determine the present state of toner in step 6c. If the "toner absent" state is continuously indicated in step 6d through the process described above, the value of n stored in process cartridge memory 71 is increased by one in step 6e. When the "toner absent" message is displayed on a liquid crystal display (LCD) of panel 4a of the image forming apparatus in step 6h, the user presumably installs a new toner cartridge. After the user installs the new toner cartridge, such as the one shown in FIG. 11, it is determined that the "toner present" state is recovered in step 6i. Accordingly, the value of m stored in process cartridge memory 71 is increased by one in step 6j.

Referring back to step 6b, if the value of n is not equal to the value of m, a determination is made as to whether the value of n equals the value of m+1 in step 6k. If the value of n is not equal to the value of m +1, an error message is displayed in step 6l. On the other hand, when the value of n is equal to the value of m+1 in step 6k (and after the value of n is increased by one in step 6e), it is determined whether the value of n equals a predetermined number k (i.e., five in the embodiment represented in Table 1) in step 6f. If the value of n equals the predetermined number k, the process cartridge exchange message indicating that the presently installed process cartridge should be exchanged is displayed in step 6g. If, however, the value of n is not equal to the predetermined number k in step 6f, the "toner absent" message is continuously displayed in step 6h until the user installs a new toner cartridge.

With reference to FIGS. 7 through 10, the second embodiment of the present invention will now be explained.

FIG. 7 shows the structure of a process cartridge A3 and a toner cartridge B1 constructed according to the second embodiment of the present invention. In FIG. 7, process cartridge A3 includes the various components such as waste toner receptacle 40, photosensitive drum 41, charging unit 42, cleaning blade 43, waste toner transfer wing 44, developing roller 46 and toner agitating wing 49 combined as a unitary structure. Toner cartridge B1 is constructed so that it can be attached to and detached from process cartridge A3. Furthermore, process cartridge A3 includes process cartridge memory 71, while toner cartridge B1 includes toner sensor 73 and a toner cartridge memory 72. The second embodiment shown in FIG. 7 is distinguished from the first embodiment shown in FIG. 2 in that toner cartridge B1 now includes toner cartridge memory 72.

FIG. 8 shows a laser beam printer in which process cartridge A3 and toner cartridge B1 of the second embodiment of the present invention are installed.

FIG. 9 is a block diagram illustrating portions of the laser beam printer constructed in accordance with the second embodiment of the present invention.

FIG. 10 is a flowchart illustrating the control operation performed by the central processing unit (CPU) of video controller **4*b* in accordance with the second embodiment of the present invention. First, values of data variables n and m respectively stored in process cartridge memory 71 and toner cartridge memory 72 are read by the central processing unit (CPU) of video controller 4*b* in step 10*a*. The value of n stored in process cartridge memory 71 has been initially set to a predetermined value (e.g., zero) during manufacturing. After the values of n and m are read from process cartridge memory 71 and toner cartridge memory 72, respectively, it is determined whether the value of m equals a threshold value q (e.g., one can assume that q equals zero when m is initially set to zero) in step 10*b*. If the value of m equals the threshold value q, the value of m stored in toner cartridge memory 72 is increased by one and at the same time, the value of n stored in process cartridge memory 71 is increased by one in step 10*c*. Then, the signal output from toner sensor 73 is analyzed and the present toner state (i.e., whether toner is present) is detected in step 10*d*. If the detected result indicates that toner is present, the toner presence/absence detecting operation is continuously repeated in steps 10*d* and 10*e*. Once the "toner absence" state is continuously detected in step 10*e*, the value of m stored in toner cartridge memory 72 is again increased by one in step 10*f*. The "toner absent" message is then displayed on user panel 4*a***. In essence, the value of m is used in the second embodiment of the present invention to indicate the remaining amount of toner within toner cartridge B1.

Next, in step **10*g*, it is determined whether the value of n stored in process cartridge memory 71 equals a specific value Q. The value of n represents the number of times an expended toner cartridge has been exchanged for a new toner cartridge. That is, assuming that the initial value of n is zero and the specific value Q is five, the value n equals the specific value Q when the toner cartridge B1 has been exchanged five times. Hence, when the value of n does not equal the specific value Q in step 10*g*, this indicates that the time for exchanging process cartridge A3 has not yet been reached, and step 10*a* is again performed. However, when the value of n equals the specific value Q, the process cartridge exchange message indicating that process cartridge A3 should be exchanged is displayed in step 10*h***.

Referring back to step **10*b*, when the value of m stored in toner cartridge memory 72 is not equal to the threshold value q, (e.g., when the printer is turned OFF, and later is turned ON after process cartridge memory 71 is installed and the value of m is increased by one), it is then determined whether the value of m equals q+1 in step 10*i*. If the value m equals q+1, normal operation is resumed in step 10*d*. On the other hand, if the value of m is not equal to q+1 (e.g., m equals q+2), an error message or a toner cartridge exchange message indicating that toner cartridge B1 should be exchanged is displayed in step 10*j*. At this time, in order to re-start the printing operation, a new toner cartridge has to be installed and the value of m stored in toner cartridge memory 72** has to be initialized.

With the second embodiment of the present invention, improper use of imitation toner cartridges can be prevented. Furthermore, problems generated by manually filling the toner cartridge with toner after the toner cartridge is detached from the process cartridge, instead of exchanging an expended toner cartridge for a new toner cartridge (such as the one shown in FIG. 11) can be prevented with the second embodiment of the present invention.

While there has been illustrated and described what are considered to be preferred embodiments of the present invention, various changes and modifications may be made without departing from the true scope of the present invention. In particular, the embodiments of the present invention have been disclosed for use within a laser beam printer. However, the present invention can also be applied to other types of image forming apparatuses. Therefore, it is intended that the present invention not be limited to the particular embodiments disclosed as the best mode contemplated for carrying out the present invention, but that the present invention include all embodiments falling within the scope of the appended claims.

What is claimed is:

1. A device for displaying an exchange message for a process cartridge installed within a body of an image forming apparatus, said device comprising:

said process cartridge comprising a non-volatile memory for storing data values, a photosensitive drum, a toner sensor for detecting a remaining quantity of toner, a cleaning blade and a waste toner receptacle combined as a unitary structure capable of being installed within and removed from said body;

a toner cartridge for storing said toner, said toner cartridge capable of being attached to and detached from said process cartridge;

display means for displaying predetermined messages; and control means for receiving a print command from a host computer and controlling a printing operation performed by said image forming apparatus, said control means incrementing said data values according to said remaining quantity of said toner detected by said toner sensor, said control means enabling said display means to display said exchange message indicating that said process cartridge should be exchanged for a new process cartridge when one of said data values representative of a number of times said toner cartridge has required exchange for a new toner cartridge equals a predetermined value.

2. The device as claimed in claim 1, further comprised of said control means enabling said display means to display a toner absence message indicating that said toner cartridge should be exchanged for said new toner cartridge when said one of said data values representative of said number of times said toner cartridge has required exchange for said new toner cartridge is incremented.

3. The device as claimed in claim 1, wherein said control means comprises a video controller.

4. The device as claimed in claim 2, wherein said control means comprises a video controller.

5. The device as claimed in claim 1, wherein said predetermined value equals five.

6. A device for displaying an exchange message for a process cartridge installed within a body of an image forming apparatus, said device comprising:

said process cartridge comprising a first non-volatile memory for storing a first value representative of a number of times a toner cartridge has required exchange for a new toner cartridge, a photosensitive drum, a toner sensor for detecting a quantity of toner remaining within said toner cartridge, a cleaning blade and a waste toner receptacle combined into a unitary structure capable of being installed within and removed from said body;

said toner cartridge for storing said toner, said toner cartridge comprising a second non-volatile memory for storing a second value representative of said quantity of said toner remaining within said toner cartridge, said toner cartridge capable of being attachable to and detachable from said process cartridge;

display means for displaying predetermined messages; and control means for receiving a print command from a host computer and controlling a printing operation performed by said image forming apparatus, said control means incrementing said second value stored in said second non-volatile memory whenever an absence of said toner is detected by said toner sensor, said control means enabling said display means to display said exchange message indicating that said process cartridge should be exchanged for a new process cartridge when said first value stored in said first non-volatile memory equals a first predetermined value.

7. The device as claimed in claim 6, further comprised of said control means enabling said display means to display a toner cartridge exchange message indicating that said toner cartridge should be exchanged for said new toner cartridge when said second value stored in said second non-volatile memory is not equal to a second predetermined value.

8. The device as claimed in claim 6, wherein said control means comprises a video controller.

9. The device as claimed in claim 7, wherein said control means comprises a video controller.

10. The device as claimed in claim 6, wherein said first predetermined value equals five.

11. A method for displaying an exchange message for a process cartridge installed within a body of an image forming apparatus comprising: said process cartridge comprised of a non-volatile memory for storing first and second data values, a photosensitive drum, a toner sensor for detecting a quantity of toner remaining within a toner cartridge, a cleaning blade and a waste toner receptacle combined as a unitary structure capable of being installed within and removed from said body; and a display means for displaying predetermined messages, said method comprising the steps of:

detecting said quantity of said toner remaining within said toner cartridge via said toner sensor;

incrementing said first data value representative of a number of times said toner cartridge has required exchange for a new toner cartridge when said toner sensor detects a toner absence state;

detecting when a toner full state is recovered via said toner sensor;

incrementing said second data value when said toner full state is recovered; and displaying, via said display means, said exchange message indicating that said process cartridge should be exchanged for a new process cartridge when said first data value equals a predetermined value.

12. The method as claimed in claim 11, further comprising a step of displaying, via said display means, a toner absence message indicating that said toner cartridge should be replaced with a new toner cartridge after said step of incrementing said first data value.

13. The method as claimed in claim 11, wherein said predetermined value equals five.

* * * * *